US007331617B2

(12) United States Patent
Johnson

(10) Patent No.: US 7,331,617 B2
(45) Date of Patent: Feb. 19, 2008

(54) CABINET DOOR LOCK

(76) Inventor: Brian D. Johnson, 21778 Scenic Pointe, Strongsville, OH (US) 44149

( * ) Notice: Subject to any disclaimer, the term of this patent is extended or adjusted under 35 U.S.C. 154(b) by 360 days.

(21) Appl. No.: 10/705,037

(22) Filed: Nov. 10, 2003

(65) Prior Publication Data

US 2005/0099103 A1 May 12, 2005

(51) Int. Cl.
*E05C 3/04* (2006.01)
*E05C 19/00* (2006.01)

(52) U.S. Cl. ..... 292/202; 29/210; 29/304; 16/82; 49/394; 312/238

(58) Field of Classification Search ..... 292/202, 292/44, 54, 210, 218, 230, 238, 297, 298, 292/304, 338, 341.15, 341.16, 341.17; 109/7, 109/8, 64, 67; 16/82, 85; 49/394; 312/238
See application file for complete search history.

(56) References Cited

U.S. PATENT DOCUMENTS 82,537 A * 9/1868 Markham ..... 292/218
249,761 A * 11/1881 Hassinger ..... 292/213
251,139 A * 12/1881 Sc hram ..... 292/216
437,559 A * 9/1890 Blandin ..... 292/44
568,638 A * 9/1896 Sweet ..... 292/44
574,518 A * 1/1897 Berry ..... 292/44
973,919 A * 10/1910 Cline ..... 292/44
980,663 A * 1/1911 Morgan ..... 292/213
1,200,260 A * 10/1916 Still ..... 292/218
1,471,206 A * 10/1923 Reynolds ..... 292/194
1,482,652 A * 2/1924 Klepper ..... 292/54
1,597,581 A * 8/1926 David-Moss ..... 292/238
1,608,588 A * 11/1926 Dundek et al. ..... 292/202
1,904,291 A * 4/1933 Neilson et al. ..... 292/67
2,074,759 A * 3/1937 Richards ..... 292/68
2,283,225 A * 5/1942 Parsek ..... 70/81
2,510,178 A * 6/1950 James ..... 292/44
2,532,586 A * 12/1950 Wickwire ..... 292/288

(Continued)

OTHER PUBLICATIONS

Safety 1st Lazy Susan Lock Product Information, Nov. 1998.
Fork Latch on Gate Product Information, Date: concede as prior art.
Fork Latch Product Information, Date: concede as prior art.

*Primary Examiner*—Carlos Lugo
(74) *Attorney, Agent, or Firm*—Brian Johnson

(57) ABSTRACT

A lock for a cabinet of the type wherein a door of the cabinet is movable through a frame of the cabinet is provided. An exemplary lock of the present invention includes a first and second restraining member connected by a rod and rotatable around an axis of rotation between a first position wherein a cabinet member is trapped between the restraining members and the door can not move through the frame and a second position wherein the door is freely movable through the frame. The lock optionally includes a mounting member having a rod-retaining section and optionally one or more rotation locks and/or one or more rotation restraints. The restraining members are optionally sized and shaped to facilitate rotation between the first and second position while accommodating different sizes and specifications of cabinet types. The lock optionally includes one or more strengthening members and end extensions angled on one or both ends of the rod. In additional embodiments of the present invention, the lock includes at least one friction pad for contacting a cabinet member and an adjustable connection between the rod and at least one restraining member.

14 Claims, 11 Drawing Sheets

U.S. PATENT DOCUMENTS 2,558,614 A * 6/1951 Jewell, Jr. ..... 292/129
3,042,435 A * 7/1962 Wieseler et al. ..... 292/213
3,285,209 A * 11/1966 Pace ..... 109/8
3,806,172 A * 4/1974 Maze ..... 292/44
3,888,527 A * 6/1975 Haisler ..... 292/213
3,976,315 A * 8/1976 Braun ..... 292/104
3,982,800 A 9/1976 Gorton et al.
4,061,371 A * 12/1977 Prather et al. ..... 292/198
4,190,379 A * 2/1980 Toro Sosa et al. ..... 404/6
4,229,060 A 10/1980 Brownlee et al.
4,392,628 A 7/1983 Hadfield et al.
4,418,970 A 12/1983 Hyder et al.
4,433,885 A 2/1984 Baker
4,440,459 A 4/1984 Hallgren
4,549,727 A 10/1985 Kozar
4,610,492 A 9/1986 Molander et al.
4,635,976 A * 1/1987 Sigler ..... 292/57
4,715,629 A 12/1987 Robinson
4,796,542 A * 1/1989 Lee ..... 109/8
4,930,819 A 6/1990 Sharp et al.
5,016,926 A 5/1991 Sharp et al.
5,114,194 A * 5/1992 Toifl et al. ..... 292/106
5,475,945 A * 12/1995 Baker ..... 49/449
5,529,352 A * 6/1996 Chin ..... 292/230
5,711,554 A 1/1998 Brown et al.
5,785,363 A 7/1998 Stopfer et al.
6,010,168 A * 1/2000 Johnson ..... 292/341.17
6,017,108 A 1/2000 Domenig
6,149,208 A 11/2000 Jubinville
6,149,209 A * 11/2000 Barton ..... 292/67
6,422,618 B1 * 7/2002 Guldner et al. ..... 292/241
7,017,958 B1 * 3/2006 Bowers ..... 292/281

* cited by examiner

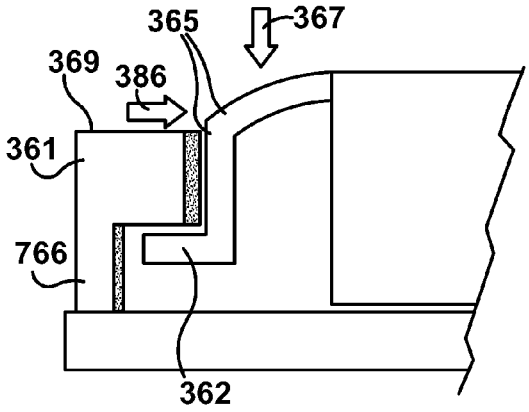
Fig. 8A
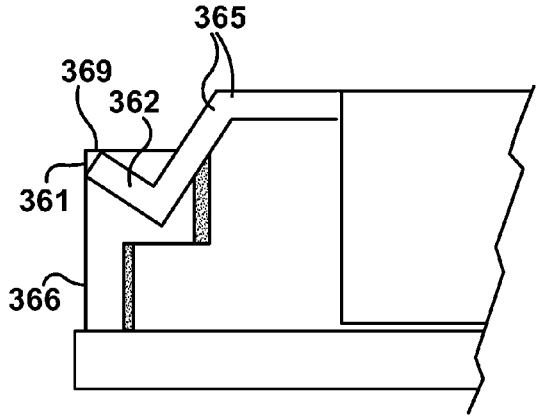
Fig. 8B
Fig. 8C
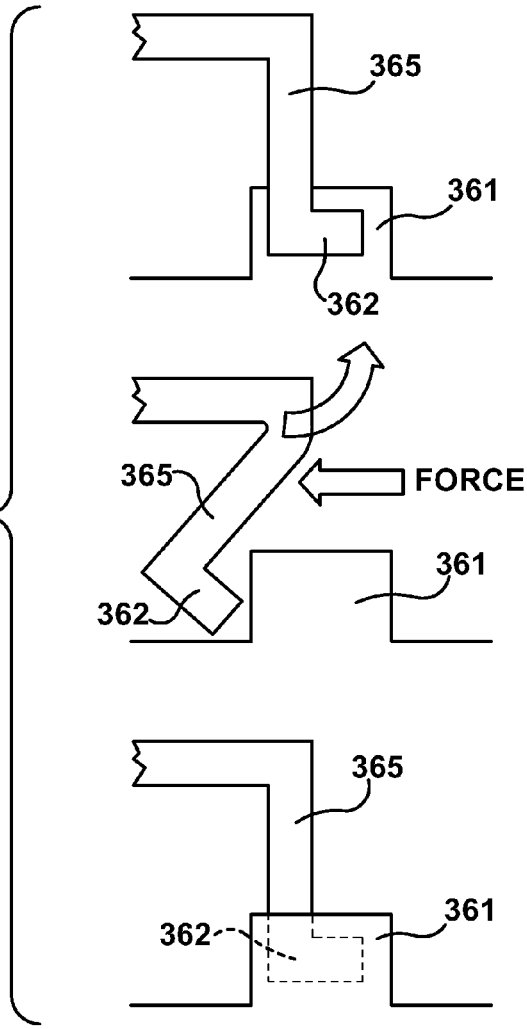

CABINET DOOR LOCK

FIELD OF THE INVENTION

The present invention relates to the locking mechanism arts. It finds particular application as a lock for a cabinet door of a cabinet type wherein the door is movable through the frame of the cabinet, such as in a Lazy Susan cabinet.

BACKGROUND OF THE INVENTION

Lazy Susan-type cabinets are found in many dwellings and other structures. Oftentimes occupying a corner of a room, such cabinets typically attempt to make use of such "corner space" by using generally circular shelves which are rotatable about a central axis. A user rotates the shelves to access items stored thereon.

Access to the shelves is usually gained via a wedge-shaped cut at the intersection of the faces of two lines of cabinets. This wedge-shaped cut is often cut into the circular shelf itself, so that in a "closed" position the wedge-shaped cut lines up with the exterior faces of the two lines of cabinets which intersect at the Lazy Susan cabinet. For aesthetic and functional reasons, panels are often added to the exterior of the wedge-shaped cut in the circular shelf, so that in the "closed" position the Lazy Susan cabinet appears to be just two more panels in the sequence of panels which comprise the face of the cabinet lines which intersect at the Lazy Susan cabinet. Such panels are usually deemed to be the "door" of the Lazy Susan cabinet.

In order to access the circular shelves of the Lazy Susan cabinet, the shelves are rotated by a user in either direction. Such rotation facilitates accessing all parts of the shelves as the shelves rotate in a complete circle. In order to allow such rotation, however, the panels attached to the wedge-shaped cut in the shelves must be shaped and sized so that they freely move through the wedge-shaped cut in the cabinet frame. To "open" a Lazy Susan-type cabinet, a user applies a force to one of the panels. The panels rotate along with the circular shelves, facilitating access to the shelves once the panels rotate through the cabinet frame.

It is often desirable to selectively restrict rotation of a Lazy Susan, such as, e.g., when a toddler is roaming around a house and very desirous of determining the contents of the Lazy Susan (the contents of which may be dangerous if consumed). Pet owners also may be desirous of restricting access to the contents of a Lazy Susan by a dog or cat up to mischief. Such restricted access, however, is desirably selective, as such a restriction should be easily by-passable by the owner of the contents in the cabinets (such as the parents of a the toddler or owners of the pet).

It is currently known to facilitate such selective restrictive access by use of child-safety lock(s). In one type of commonly available child-safety device, a cabinet lock is mounted to the frame of a Lazy Susan cabinet. The door of the cabinet is trapped between two restraining members which protrude from the mount. One of the restraining members is fixed, while the other is rotatable between a first position (wherein the door is trapped) and a second position (wherein the door may rotate in a direction opposite from the fixed restraining member). Rotation of the rotatable restraining member is controlled by a rotation-lock which is designed to be child-proof but easily actuated by an adult. In the locked position, the door can not rotate. In the unlocked position, the door is freely rotatable in a direction away from the fixed member until the previously-trapped door member reaches the fixed member after rotation of slightly less than 360°, at which time further rotation in such direction is prohibited by the fixed member. Furthermore, in the unlocked position, the door is not freely rotatable in a direction towards the fixed member while the previously-trapped door member abuts the fixed member (e.g., immediately upon unlocking the door). Such a lock thus does not facilitate continual rotation of the Lazy Susan (i.e., greater than one rotation) and furthermore does not facilitate rotation of the Lazy Susan in a direction toward the fixed member upon unlocking the lock (to facilitate access to contents directly behind the door which is trapped, a user need rotate the Lazy Susan through greater than 300°). Such restrictions are cumbersome and irritating to users who wish to access the Lazy Susan.

Another type of commonly-available child safety device employs dual cabinet locks, each of which is adapted for a cabinet of the type wherein the door rests on the face of the cabinet in the closed position (i.e., the door does not rotate through the frame). Each lock is adapted to prohibit a door from swinging in a direction away from the cabinet frame (e.g., by a hook which is temporarily removable by an adult's finger). One such lock is applied to each of sides of the wedge-shaped frame, so that each frame prohibits rotation of the Lazy Susan in a direction away from each side. Two locks are required, for use of only one lock would prohibit rotation in only one direction, thus freely allowing rotation in the other direction. Such a dual implementation is unsightly and difficult to use because, for instance, often both locks must be undone to facilitate access to the contents of the Lazy Susan (e.g., when searching requires rotation in more than one direction).

SUMMARY OF THE INVENTION

In accordance with one embodiment of the present invention, a lock for a cabinet of the type wherein a door of the cabinet is movable through a frame of the cabinet is provided. The lock includes a first and a second restraining member connected by a rod and rotatable around an axis of rotation between a first and a second position. In the first position, a cabinet member is positioned between the restraining members and the door is restricted from moving through the frame. In the second position, the door is movable through the frame. The lock may include a mounting member for mounting on a cabinet member and for retaining at least one section of the rod. The lock may further include one or more rotation locks, such as a child safety prevention lock, and one or more rotation restraints.

In accordance with another embodiment of the present invention, a lock for a cabinet having a door movable through a frame is provided. The lock includes a first and a second restraining member connected by a rod and rotatable around an axis of rotation between a first position and a second position. The first and second restraining members with the rod form at least a rigid u-shaped construct. In the first position the door is trapped between the restraining members, and in the second position the door is freely movable through the frame. The lock further includes a mounting member located between the restraining members and retaining at least one section of the rod. The lock may further include one or more rotation locks.

In accordance with still another embodiment of the present invention, a lock for a Lazy Susan cabinet having a door rotatable through a frame is provided. The lock includes a first and a second restraining member connected by a rod and rotatable around an axis of rotation between a first position and a second position. The first and second restraining members with the rod form a rigid h-shaped construct. In the first position the door is trapped between the restraining members, and in the second position the door is freely movable through the frame. The lock further includes a mounting member located between the restraining members and retaining at least one section of the rod. The lock further includes a child safety lock for selectively allowing rotation of the restraining members.

An advantage of the present invention is that a single lock may selectively restrict movement of a door through a frame and also allow movement of the door through the frame in both directions. A user of a cabinet is not restricted to accessing the contents of the cabinet via one way motion (e.g., rotation) of the cabinet trays, and a user need not use two locks to perform a similar function. A further advantage is that a cabinet lock may be mounted on a cabinet with little clearance between the top of the door and the inside of the frame. Yet a further advantage is that a cabinet lock may be mounted on a cabinet with little or no ceiling clearance room. Still yet a further advantage is that a cabinet lock may be mounted on the cabinet door, on the cabinet frame, or both. Still yet a further advantage is that a user-friendly child-safety lock for a Lazy Susan is provided. These and other aspects and advantages of the invention will be readily understood and appreciated from the following detailed description of one or more embodiments of the invention with reference to the accompanying Figures.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

FIGS. 8A-8C are side views of a rotation lock of a lock in accordance with one embodiment of the present invention;

DETAILED DESCRIPTION OF THE INVENTION

In an embodiment, the present invention is directed to a lock for a cabinet of the type wherein a door of the cabinet is movable through a frame of the cabinet. An exemplary lock of the present invention includes a first and second restraining member connected by a rod and rotatable around an axis of rotation between a first position (wherein a cabinet member is trapped between the restraining members and the door can not move through the frame) and a second position (wherein the door is freely movable through the frame). The lock optionally includes a mounting member having a rod-retaining section and optionally one or more rotation lock(s) and/or one or more rotation restraint(s). The restraining members are optionally sized and shaped to facilitate rotation between the first and second position while accommodating different sizes and specifications of cabinet types, such as, e.g., a cabinet which has minimal interior vertical clearance above the top edge of the frame or a cabinet which has minimal clearance between the top of the door and the top underside of the frame. The lock optionally includes one or more strengthening members and end extensions angled on one or both ends of the rod. In additional embodiments of the present invention, the lock includes at least one friction pad for contacting a cabinet member and an adjustable connection between the rod and at least one restraining member.

Figure 1:
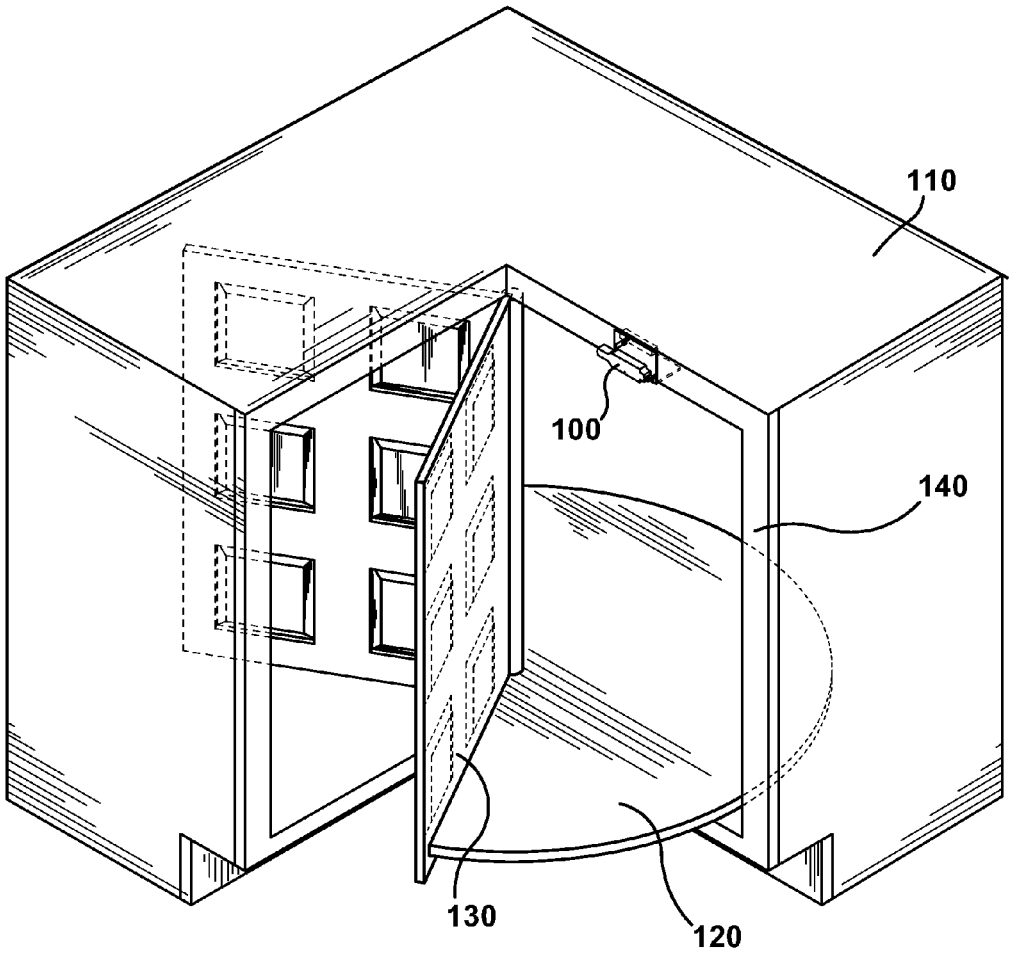
FIG. 1 is a perspective view of a cabinet having a lock in accordance with one embodiment of the present invention.

With reference to FIG. 1, an exemplary embodiment of a cabinet lock 100 of the present invention is illustrated. In this exemplary embodiment, lock 100 is mounted on frame 140 of cabinet 110. Cabinet 110 is a Lazy Susan-type cabinet wherein the door 130 of the cabinet is rotatably movable through the frame 140. Upon rotating door 130, a user may access one or more Lazy Susan shelves 120 and the contents thereon. While this embodiment and other exemplary embodiments of the present invention described herein are described in relation to a Lazy Susan-type cabinet, it will be appreciated that a lock of the present invention may be used with any cabinet of the type wherein a door of the cabinet is movable through a frame of the cabinet, and the disclosure herein is not intended to be limited to Lazy Susan-type cabinets.

In a Lazy Susan cabinet of the type illustrated in FIG. 1, the door 130 of the cabinet is typically wedge-shaped and comprised of two intersecting panels which typically have the external appearance of the other cabinets adjacent to the Lazy Susan. As used herein, "door" is used generically and includes, but is not limited to, one or more of the panels of the wedge-shaped cutout of a Lazy Susan cabinet which, in the closed position, are approximately flush with the exterior face of the cabinet and further are shaped and sized to facilitate movement (e.g., rotation) through the frame of the cabinet. As used herein, "cabinet member" is either one or more cabinet doors or one or more cabinet frames, or one or more portions or sections of each, or both. While in FIG. 1 lock 100 is illustrated as being mounted on frame 140, it will be appreciated that lock 100 is optionally mounted upon any suitable portion of any suitable cabinet member.

Figure 2A:
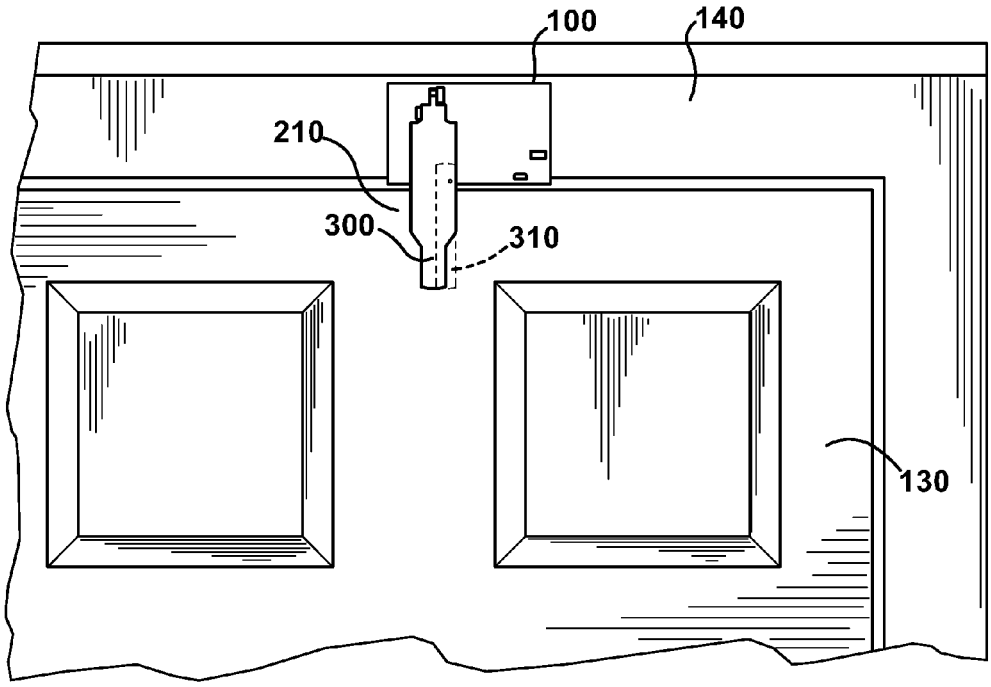
FIGS. 2A and 2B are a side view of a lock mounted on a cabinet member in accordance with one embodiment of the present invention.
Figure 2B:
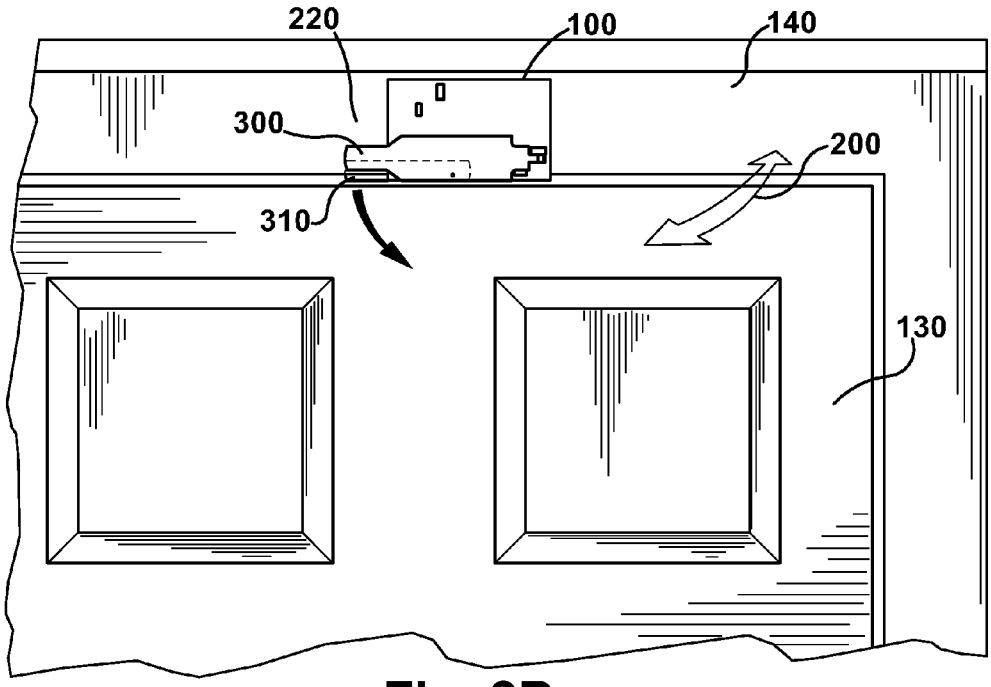

With reference to FIGS. 2A and 2B, an exemplary lock 100 is illustrated in a first position 210 and in a second position 220. In the first position 210, the door 130 is trapped between first and second restraining members 300 and 310 (as described further herein). In this position, the door 130 is not freely movable through the frame 140 and is thus "locked" until the first and second restraining members are rotated into the second position. In the second position 220, the door 130 is no longer trapped between the restraining members and is free to move 200 in either direction through the frame 140. In the embodiment illustrated in FIGS. 2A and 2B, the restraining members are rotatable clockwise by about 90° from the closed position 210 (i.e., facing downward) to the open position 220 (i.e., horizontal), and counterclockwise by about 90° from the open position to the closed position. While this exemplary embodiment is illustrated with a clockwise opening direction and a counterclockwise closing direction, it will be appreciated that opposite directions of opening and closing may be implemented in other embodiments of the present invention. Furthermore, it will be appreciated that while this exemplary embodiment illustrates an approximately 90° rotation, any suitable amount of rotation may be used. For example, a rotation of as little of 1° or 2° from the second position 220 is suitable if the restraining members are adapted so as to prohibit movement of the door through the frame at such a rotation. Furthermore, a rotation of greater than 90° is also suitable if the restraining members are so adapted.

With reference to FIGS. 3A-3G, an exemplary lock 100 of the present invention is illustrated. Exemplary lock 100 includes a first restraining member 300, a second restraining member 310, a rod 320 and optionally a mounting member 340. The first and second restraining members 300 and 310 are connected by the rod 320 and are rotatable about an axis of rotation 330 defined generally by the rod 320.

First and second restraining members 300 and 310 are any suitable shape and size for prohibiting movement of the door 130 through the frame 140 in the first position and for facilitating movement of the door 130 through the frame 140 in the second position. In an embodiment, the restraining members are generally rectangular in shape (see, for an additional example, the restraining members of Figures series 6 and 7).

The restraining members may each or both be shaped to accommodate one or more features of a cabinet. For example, either or both restraining members 300 and 310 may have generally planar exterior edges 370 which, when in the second position, are generally co-planar with either or both mounting member 340 (described further herein) and/or the top of door 130. In this regard, when in the second position, the restraining members are removed as much as possible from inhibiting movement of the door through the frame. In embodiments including a mounting member 340, the restraining members may be adapted so that the exterior edges 370, while in the second position, extend no further from the frame 140 than the mounting member 340 (e.g., the external edges 370 are co-planar with or not extending as far as the underside plane of the mounting member). Either restraining member is optionally shaped for aesthetic or other purposes. For example, first restraining member 300 optionally has an outer end 380 which is narrowed with respect to the remainder of the restraining member. In this regard, the first restraining member 300, while in the first position, obscures less of the external appearance of the door while maintaining the ability to trap the door and further maintaining the ability to, while in the second position, facilitate movement of the door through the frame.

In embodiments of the present invention wherein the rod is mounted through the frame (as described herein), the exterior edges 370 may be adapted so as to either (while in the second position) not extend beyond the edge of the cabinet member upon which they are mounted or so as to extend any suitable distance from the cabinet member upon which they are mounted. In embodiments of the present invention wherein the rod is mounted upon the frame (such as, e.g., with a mounting member 340), the exterior edges 370 are adapted to (while in the second position) extend any suitable distance from the cabinet member upon which they are mounted. A distance is suitable if it allows movement of the door through the frame while the restraining members are in the second position. In an embodiment wherein the exterior edges 370 extend beyond the cabinet member upon which the restraining members are mounted, the distance between the exterior edges 370 and the portion of the cabinet member upon which the restraining members are mounted is determined by the distance between the door and frame at the point where the lock is attached, and is generally between one tenth of an inch and five inches. An exemplary distance that the exterior edges 370 extend from the cabinet member is between about one-sixteenth of an inch and about one-quarter of an inch. In another embodiment, an exemplary distance is about one-eight of an inch. It will be appreciated that one restraining member need not have the same size or shape as the other.

Each restraining member is adapted to any suitable length. For example, the second restraining member may have a shorter length adapted for cabinets with reduced vertical clearance. Many cabinets have an interior ceiling which is significantly higher than the underside of the top of the frame 140. In such cabinets, the second (here, the internal) restraining member 310 may be of equal or greater length than the first restraining member, as sufficient clearance exists as the restraining members are rotated to the first position and the inner end 390 of the second restraining member rotates up into the internal ceiling area of the cabinet. Many other cabinets, however, have an interior ceiling which does not have significant clearance from the underside of the top of the frame. The vertical difference between the underside of the frame and the underside of the ceiling may be half an inch or less. As such, rotation of the second restraining member along the axis of rotation 330 (discussed further herein) may be inhibited as the inner end 390 comes in contact with the ceiling of the cabinet. In an embodiment of the present invention, the length of either restraining member, and particularly the second restraining member, is adapted to facilitate rotation into the second position in a cabinet having a reduced ceiling clearance. The length is adapted in any suitable manner. For example, the distance from the inner end 390 to the axis of rotation 330 is reduced to facilitate rotation of the second restraining member into the first position. The distance between the inner end 390 and the axis of rotation 330 may be less than the distance between the inner end 392 and the axis of rotation. In an embodiment, this difference is about one-half of an inch or less. In an embodiment, the inner end 390 of the second restraining member is shortened to the axis of rotation 330. In another embodiment, the inner end 390 of the second restraining member is shortened to extend beyond the axis of rotation while in the first position by an amount equal to or slightly less than the clearance between the top of the door and the underside of the ceiling of the cabinet, which is generally between one tenth of an inch and one inch. In an embodiment, the inner end 390 extends one-half of an inch from the axis of rotation.

First and second restraining members 300 and 310 are connected by rod 320. In an embodiment of the present invention, rod 320 is connected to each restraining member in any suitable manner which facilitates concurrent rotation of both restraining members and further maintains a relatively constant distance between the restraining members. In this regard, when one of the restraining members is rotated about the axis of rotation 330, as generally defined by the rod 320, the rod transfers this rotational motion to the other restraining member so that the other restraining member rotates with the first restraining member. For example when a lock of the present invention is mounted on a cabinet frame, the first restraining member is easily accessible to a user, while the second restraining member is located towards the interior of the cabinet. The user may grasp the first restraining member and rotate the first restraining member between the first and the second positions. The rod 320 transfers the rotational motion of the first restraining member to the second restraining member, whereby the second restraining member moves in concert with the first restraining member. As such, when the first restraining member is moved between the first and second position, the second restraining member is similarly moved, thus locking and unlocking the door.

The rod 320 furthermore maintains a relatively constant distance between the restraining members (which is optionally adjustable, as described below). For example, the rod 320 is sized with any suitable length for maintaining a distance between the restraining members which is suitable for trapping a cabinet member. A suitable trapping distance is any distance which is greater than the width of the cabinet member to be trapped. Optionally, the trapping distance is sized to be only slightly wider than the width of the cabinet member to be trapped, as such a slight increase in width provides a "snug" fit which inhibits "play" or rattling of the cabinet member while it is trapped by the restraining members. Exemplary trapping distances range from about one-quarter of an inch to about two inches. In an embodiment, a trapping distance is about one inch. At such a suitable trapping distance, while in the first position, the restraining members trap a cabinet member and prohibit the door from moving through the frame. In an exemplary embodiment, the first and second restraining members and the rod form a generally rigid "H"-shaped construct which, while in the first position, prohibit movement of the door through the frame as the outer ends of each restraining member contact the door, the inner ends of each restraining member contact the frame, and the rod maintains a fixed distance between the restraining members which maintains each restraining member in contact with both the door and the frame. Movement of the door towards the first restraining member is restricted by overlap of the inner end 390 of the second restraining member with the frame 140. Movement of the door away from the first restraining member is restricted by overlap of the inner end 392 of the first restraining member with the frame 140.

In an exemplary embodiment including a mounting member 340 (described further herein), the first and second restraining members and the rod form a generally rigid "h"-shaped construct wherein the inner end 390 is in line with or co-planar with the axis of rotation, and does not extend beyond the axis of rotation. In this embodiment, the cabinet member (in the first position) is trapped between the restraining members which themselves are connected by the rod which is rigidly (in terms of lateral movement) mounted to another cabinet member by the mounting member. As the restraining members are rigidly connected to the rod, and as the rod is rigidly connected to the other cabinet member, the restraining members are prohibited from lateral movement. When the first cabinet member is trapped between the restraining members, it similarly is prohibited from movement.

In yet another exemplary embodiment (not shown) including a mounting member 340, the first and second restraining members and the rod form a generally rigid "u"-shaped construct wherein the inner ends 390 and 392 are in line with or co-planar with the axis of rotation, and do not extend beyond the axis of rotation. Movement of the door while in the first position is prohibited similarly as described above for the generally "h"-shaped construct. While the previous few embodiments have been described with reference to "H", "h" and "u" shaped constructs consisting of the first and second restraining member with the rod, it will be appreciated that such constructs may be as few as one piece; e.g., the construct may be integral. In such an example, the restraining members and the rod are integral, with each comprising a section of the overall construct. It will be understood that reference to the restraining members and the rod forming a construct of any shape (including but not limited to "H", "h" and "u") means forming a construct of one or more pieces, which includes but is not limited to a single, integral construct (having, e.g., a first and second restraining member section and a rod section) and a construct with more than one piece (e.g., a first and a second restraining member connected by a rod). Furthermore, it will be understood that "rigid," as used herein, is used generically and includes, but is not limited to, being generally rigid.

Figure 3A:
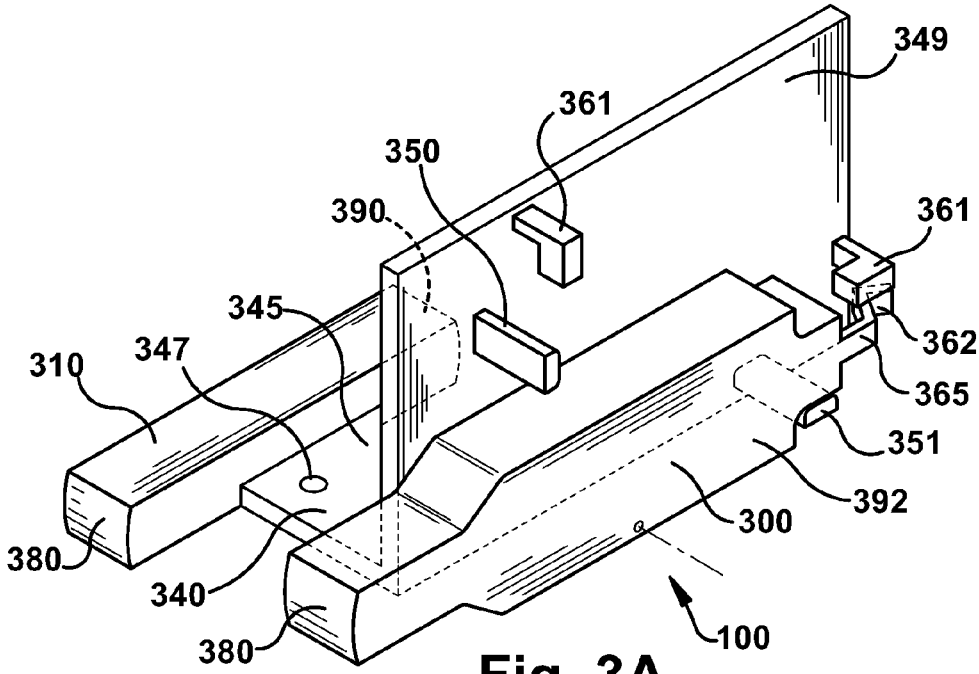
FIGS. 3A and 3B are perspective views of a lock in accordance with one embodiment of the present invention.
Figure 3B:
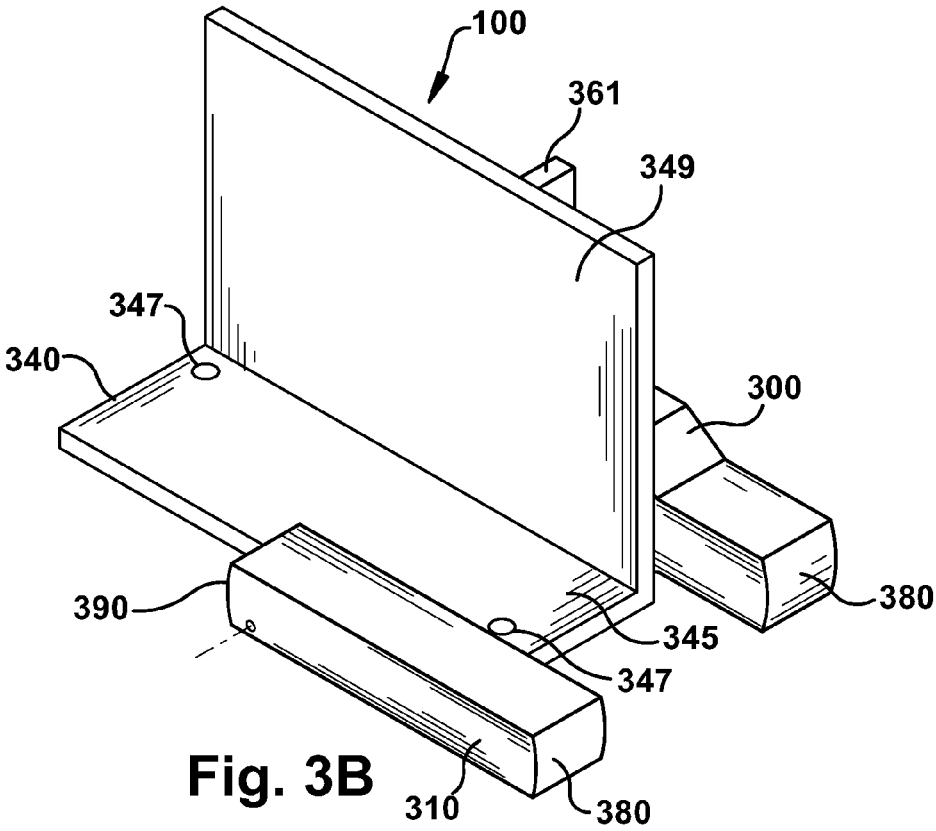
Figure 3C:
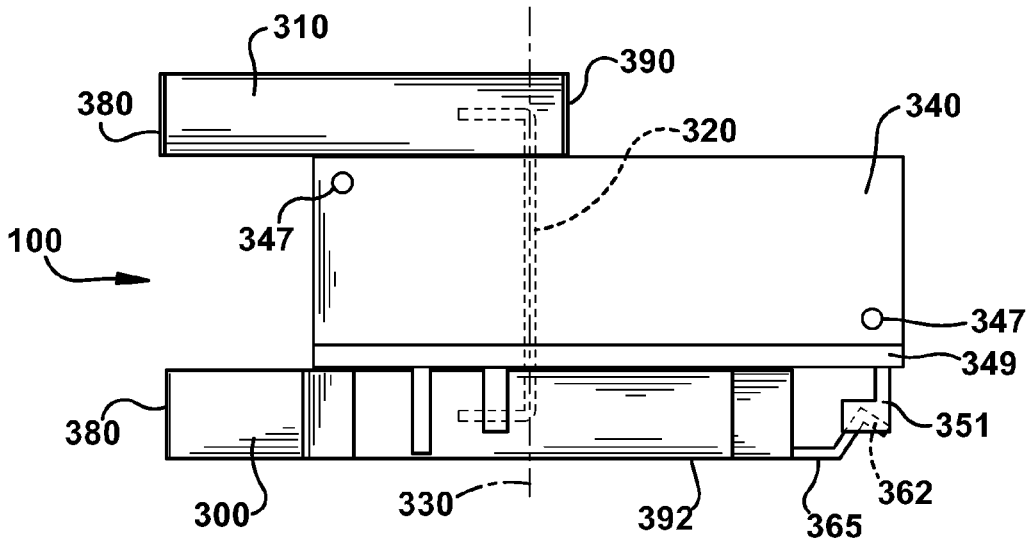
FIG. 3C is a top view of a lock in accordance with one embodiment of the present invention.
Figure 3D:
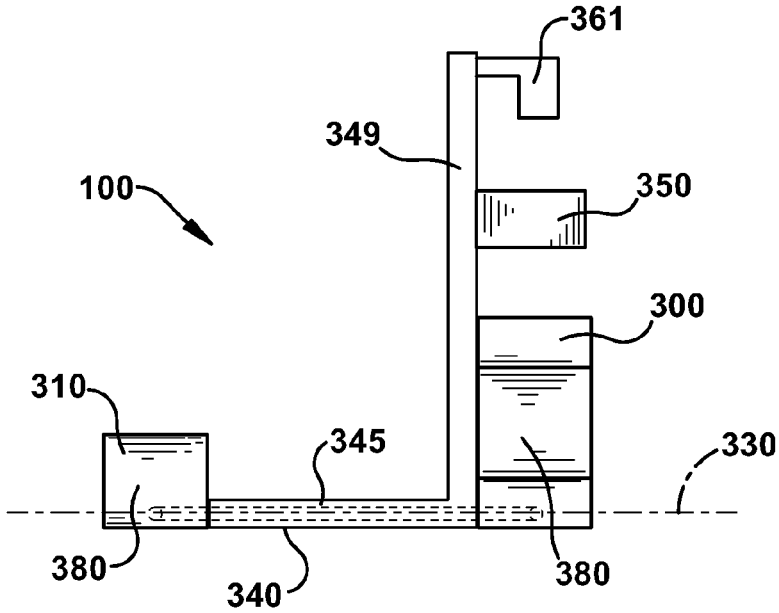
FIGS. 3D and 3G are front views of a lock in accordance with one embodiment of the present invention.
Figure 3E:
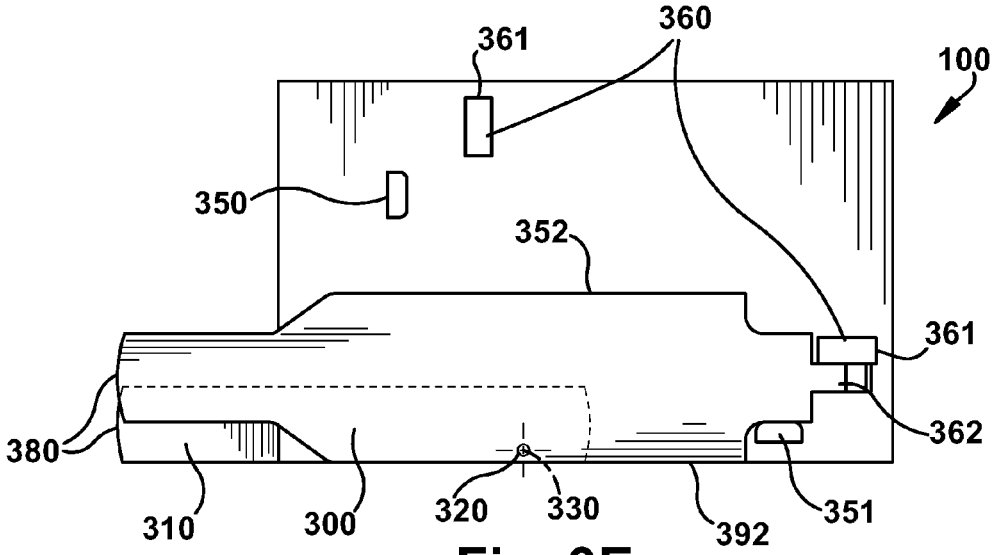
FIGS. 3E and 3F are side views of a lock in accordance with one embodiment of the present invention.
Figure 3F:
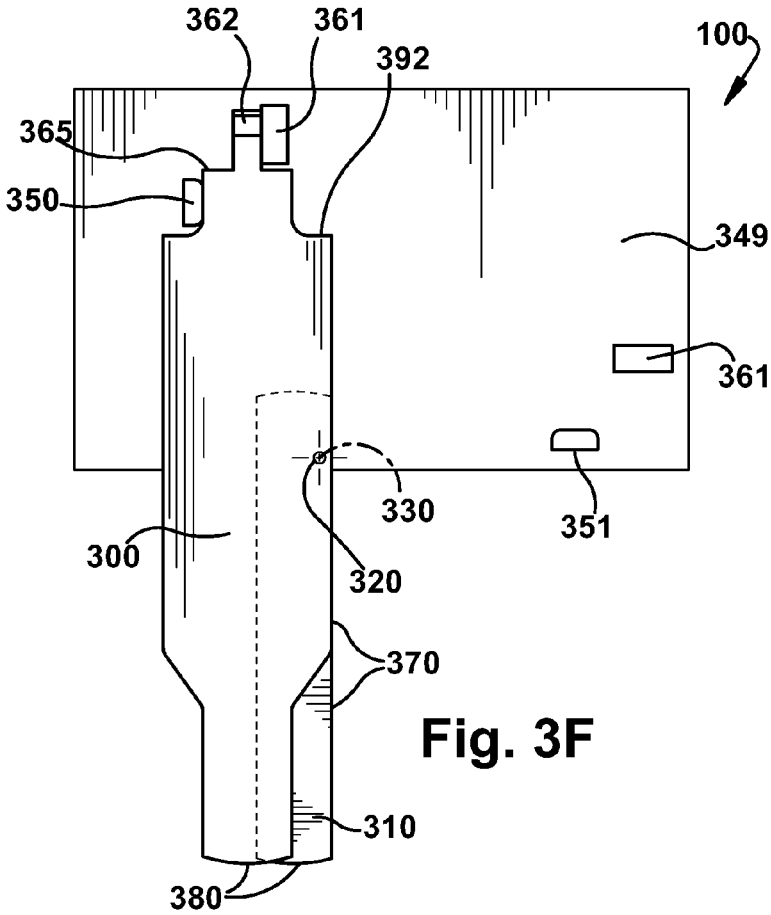
Figure 3G:
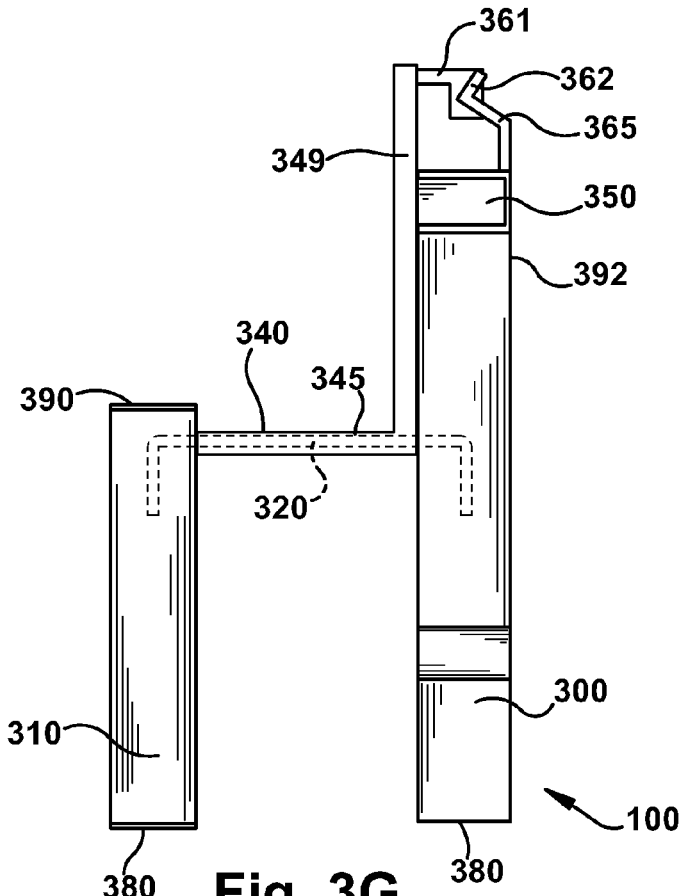
Figure 4A:
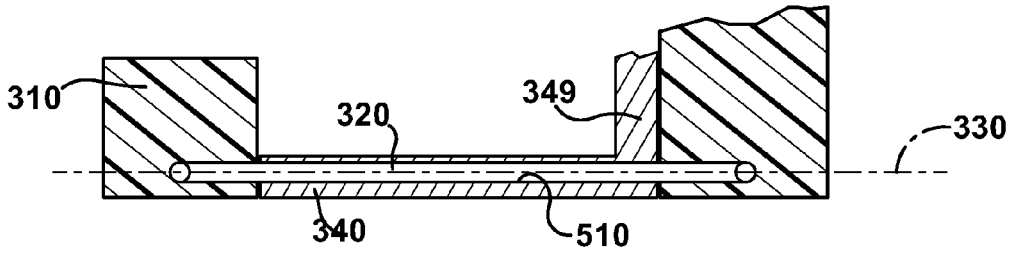
FIGS. 4A and 4B are cross-sectional views of a lock in accordance with one embodiment of the present invention taken along the axis of rotation of a rod of the lock.
Figure 4B:
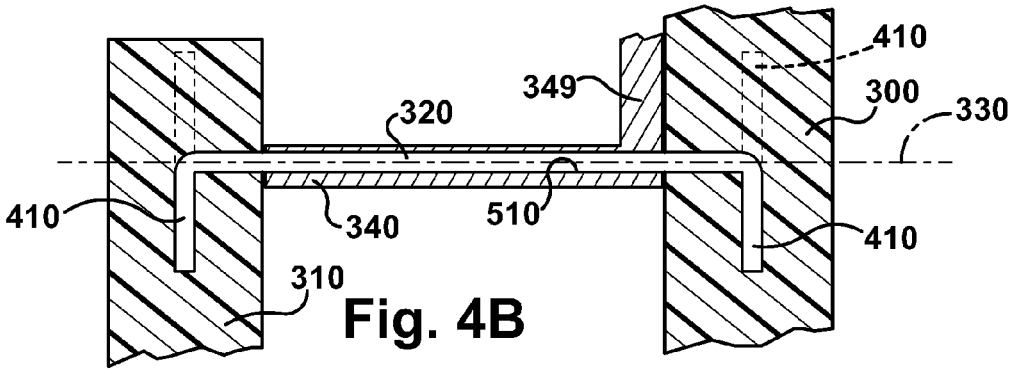

With reference to FIGS. 4A and 4B, and with further reference to FIGS. 3C, 3D and 3G, rod 320 is connected to each restraining member 300 and 310 in any suitable manner so that rotational motion of one restraining member is transferred to the other restraining member, and furthermore so that the relative distance between the restraining members is maintained. An example of such a suitable connection is to embed an end of the rod into each restraining member. In such an example, the embedded end may have textures or grooves imparted thereon in order to inhibit slippage of the rod out of the restraining member. A typical such groove is a threaded screw. In such an exemplary embodiment, each end of the rod is screwed into a restraining member. Another exemplary way of such a suitable connection is to include a flange at or near each edge of rod 320. Such a flange is optionally embedded into each restraining member. Further optionally, the rod is adapted to extend completely through each restraining member and end with a flange which abuts an outer face of each restraining member.

In still another suitable embodiment, rod 320 has one or more end extensions 410 on one or more end. Each or any end extension is optionally embedded in one or more restraining members. An exemplary end extension extends at roughly a 90° angle from the longitudinal axis of the rod 320 in either or both directions along the length of a restraining rod. While this embodiment is described in terms of 90° angled connection, it will be appreciated that any suitable angle may be used. Each end extension 410 may optionally run the entire length of a restraining member from the rod to an end of the restraining member. Optionally more than one end extension 410 is attached to one or both ends of rod 320. In this regard, the end extensions may extend in opposite directions from the rod 320, forming a rigid "T" construct. Further optionally, "T" constructs are added at each end of rod 320, wherein the rod 320 has an overall structure similar to a rigid "H".

With reference to FIG. 3D, rod 320 generally defines an axis of rotation 330 for the rod and the restraining members. In a still further embodiment of the present invention, with reference to the FIG. 3 and FIG. 4 series, rod 320 is optionally at least partially retained by a mounting member 340. Mounting member 340 includes rod retaining section 345 and optionally rotation-lock retaining section 349.

Mounting member 340 is adapted for mounting on a cabinet member by any suitable mechanism and in any suitable manner. For example, mounting member 340 is adapted to receive one or more screws and/or nails for mounting the member 340 onto a cabinet member. While embodiments of the present invention will be described with reference to mounting via one or more screws, it will be appreciated that any suitable mounting mechanism, such as one or more clips, one or more vices, adhesive(s), Velcro, magnets or other vehicles for electromagnetic forces (such as electrostatic charge) may be used. In an embodiment, with reference to FIG. 3B, two offset and recessed screw holes are used as a mounting mechanism for mounting member 340. Such exemplary screw holes optionally include recessed voids on the underside of the mounting member 340 for receiving the head of a screw so that the screw head, when screwed into the screw hole and the cabinet member, is contained within the void and does not project beyond the outer face of the mounting member 340. Each exemplary screw hole is offset from the center of the mounting member (e.g., each is located close to an opposite corner of the mounting member) to inhibit shifting and/or rotation of the mounting member 340 while the member is mounted to a cabinet member.

A rod-retaining section 345 of mounting member 340 is adapted to receive at least one section of rod 320. Rod-retaining section 345 is any suitable thickness for receiving at least one section of rod 320. For example, with reference to FIGS. 4A, 4B and 5A, rod-retaining section 345 includes a bore 510 adapted to receive rod 320. Bore 510 is shaped and sized to facilitate rotation of rod 320 along the axis of rotation 330. Optionally, the retained section of rod 320 and bore 510 are both generally cylindrical in shape, with bore 510 having a diameter just slightly larger than that of the retained section of rod 320. In that regard, the rod 320 is frictionally rotatable within the bore 510 but is prohibited from radial movement or shifting.

In embodiments of the present invention which include a mounting member 340, it is likely that the mounting member 340 will receive a significant portion of the force of the door when a user attempts to move a door which is trapped by restraining members connected by rod 320 which is itself partially retained by the mounting member 340. As such, mounting member 340 is adapted to be reasonably strong enough to resist such force while retaining the rod 320 and while remaining mounted upon a cabinet member. Mounting member 340 is so adapted in any suitable manner. For example, with reference to FIGS. 4A and 4B, mounting member 340 is constructed with a an amount of material above, below and on each side of bore 510 sufficient to resist a reasonable force applied by a user to a door. In another example (not shown), bore 510 is at least partially open (i.e., not entirely defined by rod-retaining section 345) and at least one part of rod 320 is retained by plate or other mechanism which is attached to the rod-retaining section 345 by any suitable mechanism. Any suitably strong material may be used in all or part of rod-retaining section 345, including by not limited to plastic, vinyl, metal or combinations thereof. Rod-retaining section 345 is adapted with a thickness which facilitates movement of the door through the frame while the retaining section 345 is mounted to a cabinet member. For example, rod-retaining section 345 has a thickness which is not greater than the distance between an edge of the door and the edge of the frame, which is generally between about one-sixteenth of an inch and about one-half of an inch. In a particular embodiment of the present invention, rod-retaining section 345 has a thickness of about one-eight of an inch.

Figure 5A:
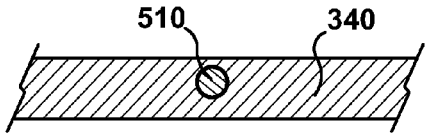
FIGS. 5A and 5B are a cross-sectional views of a mounting member of a lock in accordance with one embodiment of the present invention.
Figure 5B:
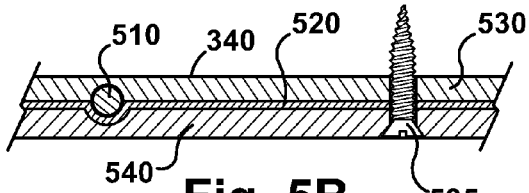
Figure 5C:
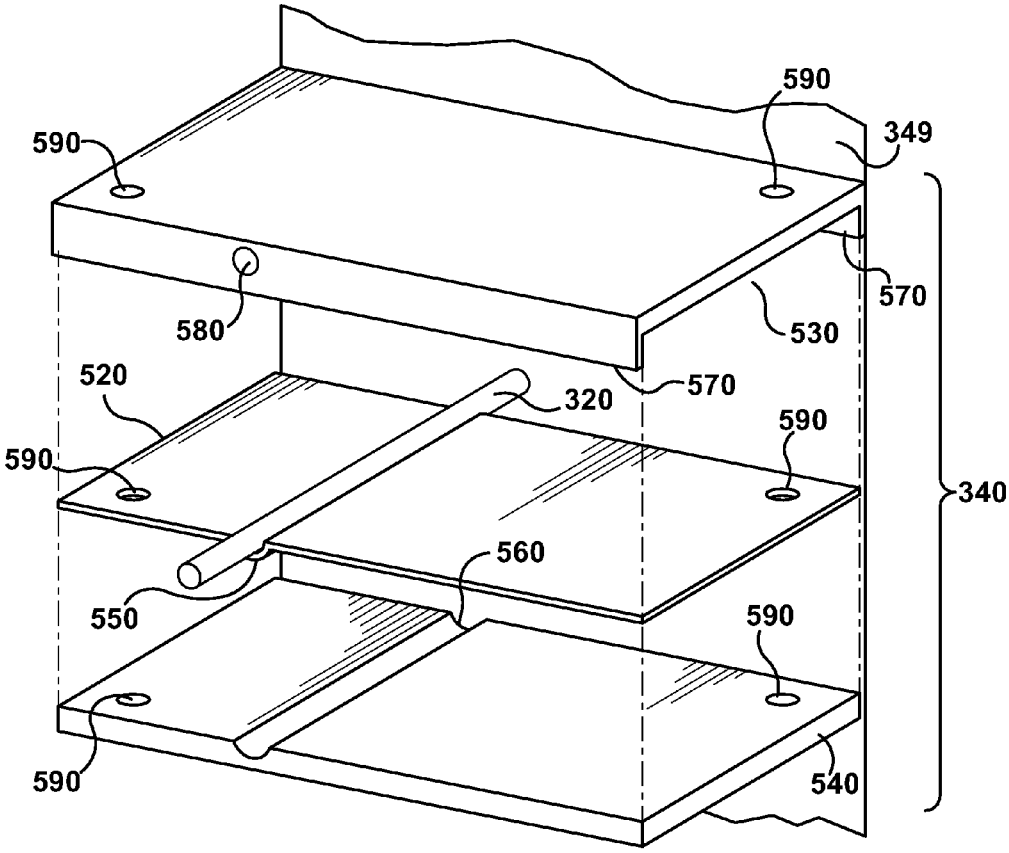
FIG. 5C is an exploded view of a mounting member of a lock in accordance with one embodiment of the present invention.

With reference to FIGS. 5A-5C, in an embodiment, rod-retaining section 345 includes one or more strengthening plates 520. Strengthening plate 520 is optionally sandwiched between top 530 and bottom 540 parts of rod-retaining section 345. Strengthening plate 520 is optionally made of any suitable material, including but not limited to metal, which exhibits suitable strength in a relatively thin plate. As such, strengthening plate 520 adds strength to lock 100 while not adding significant thickness to rod-retaining section 345. Strengthening plate 520 is adapted to receive rod 320. For example, strengthening plate 520 optionally has a depression 550 shaped and sized to at least partially retain rod 320. When strengthening plate 520 with depression 550 is sandwiched between top 530 and bottom 540 parts of rod-retaining section 345, a rod 320 in depression 550 is retained by depression 550 and the under side of top part 530. Bottom part 540 is optionally adapted with a depression 560 which receives depression 550 when the plate 520 is sandwiched between the top 530 and bottom 540 parts. Top part 540 optionally includes one or more lips 570 adapted to receive plate 520 and bottom part 540 and further adapted to include a bore 580 for receiving a section of rod 320. In this example, rod 320 extends through the bore 580 of each lip 570 and is retained by depression 550 in plate 520 and the underside of top part 530. Screw holes 590 are optionally drilled in each the top part 530, the bottom part 540 and plate 520 whereby one or more mounting screws 595 may serve the dual purpose of mounting the rod-retaining section and keeping the top part 530, the plate 520 and the bottom part 540 sandwiched together. While this embodiment has been illustrated with one or more screws used to keep the rod-retaining parts and the plate together, it will be appreciated that any suitable mechanism may be used to keep the parts together, including but not limited to an adhesive, one or more clips or vices, and/or form-fitting parts such as "snap-together" parts. It will also be understood that rod-retaining section 345 may be a single integral part with strengthening plate 520 embedded therein.

With further reference to the FIG. 3 series, mounting member 340 optionally includes rotation lock retaining section 349. Rotation lock retaining section 349 optionally includes one or more rotation locks 360 and/or one or more rotation restraints 350, 351. In the exemplary embodiment illustrated in the FIG. 3 series, rotation lock retaining section 349 is generally normal to the rod-retaining section 345 of the mounting member 340 and sharing a common edge therewith. While the rotation lock retaining section 349 is illustrated in this embodiment as being attached to and normal to the rod-retaining section 345, it will be appreciated that the rotation lock retaining section 349 may be separate and apart from the rod-retaining section (e.g., as illustrated below with respect to FIGS. 6A and 6B) and need not be normal thereto.

Rotation lock retaining section 349 is any suitable shape and size for including one or more rotation locks 360 and/or one or more rotation restraints 350. In the embodiment illustrated in the FIG. 3 series, rotation lock retaining section 349 is generally rectangular with a length generally equal to the length of the rod-retaining section 345. Rotation lock retaining section 349 optionally includes one or more screw holes 347 (not shown) or other suitable mounting mechanism for mounting a lock 100 onto a cabinet member. Rotation lock retaining section 349 optionally includes one or more rotation restraints 350 and 351.

Rotation restraints 350 and 351 optionally restrict rotation of the restraining members. For example, it may be desirable to limit rotation of the restraining members to the 90° rotation required to rotate the restraining members from the first to the second position and back (i.e., rotation beyond 90° may have undesirable consequences). A rotation restraint is any suitable construct for restricting rotation of the restraining members, including but not limited to a bump, a raised surface, a block, a catch and a void. In the exemplary embodiment illustrated in the FIG. 3 series, rotation restraints 350 and 351 are raised surfaces which rise above the outer face of the rotation lock retaining section 349. The rotation restraints rise far enough above the face of the rotation lock so as to engage a side of a restraining member (or other element attached thereto, such as, e.g., a tab) and thereby prohibit the restraining member from rotating beyond the rotation restraint. Each rotation restraint is located upon the rotation lock retaining section 349 so as to stop the rotation of the restraining member at a certain point. For example, rotation restraint 350 is situated in the upper left corner of the rotation lock retaining section 349 so that when the first restraining member 300 rotates counterclockwise the top edge 352 of the first restraining member 300 contacts the rotation restraint 350 when the first restraining member has reached a fully vertical position (e.g., in the fist position). The first restraining member 300 is thus prohibited from further counterclockwise rotation beyond the rotation restraint 350. Similarly, rotation restraint 351 is situated in the lower right corner of the rotation lock retaining section so as to prohibit clockwise rotation of the first restraining member 300 beyond the fully horizontal position (e.g., in the second position). It will be appreciated that any suitable number of rotation restraints may be used, and that such restraints are used at any suitable location(s) to restrict rotation of the restraining members to any suitable range. It will further be appreciated that a rotation restraint may take any suitable form, including but not limited to a void such as a channel or a crevice which is adapted to receive a protrusion from the restraining member; such a void is adapted to end (and thus prohibit movement of the protrusion of the restraining member) at a point beyond which the restraining member is not desired to rotate.

Rotation lock retaining section 349 further optionally includes one or more rotation locks 360. A rotation lock is any suitable mechanism for selectively prohibiting or allowing rotation of the restraining members. Exemplary suitable mechanisms include known child-restraint locking/unlocking mechanisms (e.g., a child safety lock). Generally speaking, such mechanisms include a lock or a lock trigger which may be actuated or triggered by the actions of an adult but not by a non-adult, such as a toddler. Typically, such mechanisms require a level of force which a child can not provide, or require a combination of actions which a child usually can not master, or incorporate dimensions which not readily accessible to a child (such as requiring a longer finger to reach a trigger), or combinations thereof. A typical rotation lock includes a pin or tab which is attached to an extension which is movable, usually by bending, upon the application of force at a certain point of the extension. The force and dexterity of an adult is required to apply force properly to the extension in order to effectuate movement of the pin. Only when the pin is moved is the required action (e.g., opening of a cabinet or a refrigerator door) facilitated. Movement of the pin is usually away from a receiving aperture or a blocking restraint, such as when a pin is removed from an aperture or when a tab is moved from a blocking restraint.

A rotation lock 360 is optionally located on one or more restraining members, on the rotation lock retaining section, the rod retaining section, or any combination thereof. For example, a rotation lock may include a plurality of components, some of which are contained on the rotation lock retaining section and some of which may be contained on one or more restraining members.

An exemplary rotation lock is illustrated in the FIG. 3 series. In this exemplary embodiment, rotation lock 360 includes a plurality of blocking restraints 361 and an actuator tab 362. With particular reference to FIGS. 3E and 3F, each blocking restraint 361 is located proximate to a related rotation restraint 350 or 351 whereby the inner end 392 of the first restraining member 300 may be constrained between rotation restraint 350 and blocking restraint 361 when the restraining member 300 is in the first position, and between rotation restraint 351 and the other blocking restraint 361 when the restraining member is in the second position. In the first position, the restraining member 300 is prohibited from moving counterclockwise by rotation restraint 350 and is further prohibited from moving clockwise by the blocking restraint 361 closest to the rotation restraint 350. Similarly, in the second position, the restraining member 300 is prohibited from moving clockwise by the rotation restraint 351 and is further prohibited from moving counterclockwise by the blocking restraint 361 closest to the rotation restraint 351. The restraining member 300 is prohibited from moving in the above situations in that it is blocked on one side by a rotation restraint abutting an edge of the restraining member 300 and on the other side by the blocking restraint 361 abutting actuator tab 362 on the inner end 392 of the restraining member 300. In order to rotate the restraining member in the direction of either blocking restraint, actuator tab 362 must be actuated by a user.

With further reference to FIGS. 3A, 3C and 3G, and with additional reference to FIGS. 8A-8C, exemplary embodiments of actuator tab(s) in use with rotation lock(s) of the present invention are illustrated. Actuator tab 362 is optionally attached to the inner end 392 of the restraining member 300 by extension 365. Extension 365 is made of any suitable flexible material, such as, e.g., plastic, which flexes upon exertion of a force at a level which is routinely exhibited by an adult's finger but which is not usually obtainable by a child's finger. With reference to FIGS. 3G and 8B, when no force is applied to extension 365, extension 365 is adapted to position tab 362 so that tab 362 abuts blocking restraint 361. With reference to FIG. 8A, when a force or a combination of forces 367 and/or 368 are applied to extension 365 (e.g., by an adult's finger), the extension 365 bends or flexes so that the attached tab 362 is positioned so that it does not abut blocking restraint 361 and may freely move thereby. As illustrated in FIG. 8A, the extension and tab are configured so that upon application of force, the tab slips under blocking restraint 361. In this example, blocking restraint is suitably shaped to provide a large blocking surface at the height of the tab without a force exerted thereon, and to provide a smaller blocking surface at the height of the tab with a force exerted thereon. While this example illustrates a blocking restraint having a narrow base pillar 366 and a wider block 369 on top thereof, it will be appreciated that any suitable shape or size of blocking restraint may be used. For example, with reference to FIG. 8C, blocking restraint 361 may comprise a simple block, wherein when force is applied to extension 365 tab 362 is moved clear of the block and may freely pass thereby. Furthermore, it will be appreciated that any suitable size, shape and configuration of extension 365 and tab 362 may be used. Still furthermore, while the rotation locks of the above examples have been described with reference to extensions and blocking restraints, it will be appreciated that any suitable locking mechanism may be used, including but not limited to locking mechanisms including spring-biased tabs or flanges and hook constructs.

Figure 6B:
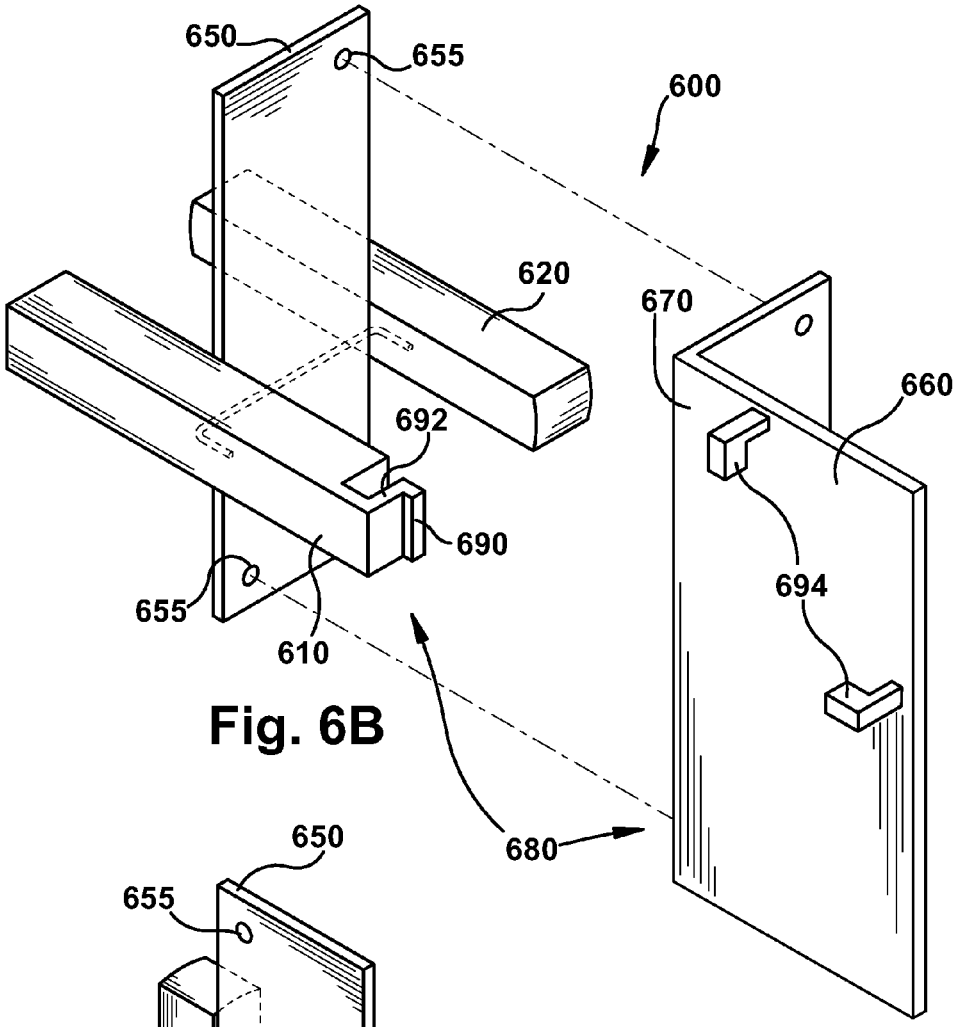
FIGS. 6A and 6B are perspective views of a lock in accordance with one embodiment of the present invention.
Figure 6A:
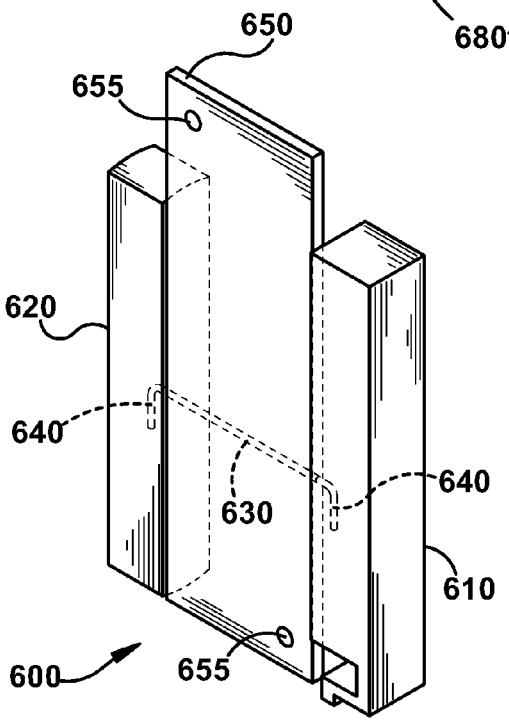
Figure 7C:
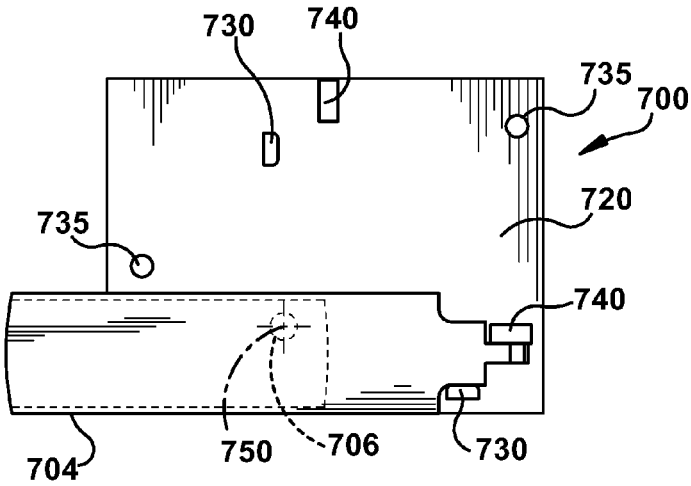
FIG. 7C is a side view of a lock in accordance with one embodiment of the present invention.
Figure 7D:
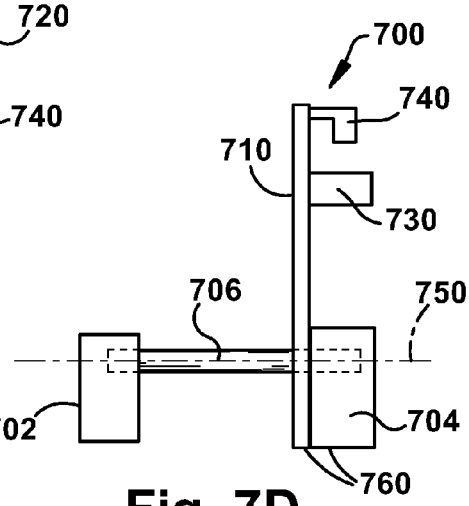
FIG. 7D is a front view of a lock in accordance with one embodiment of the present invention.
Figure 7B:
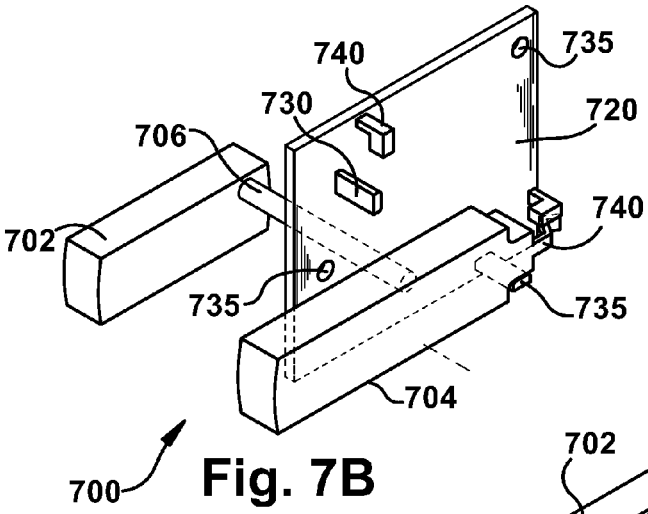
FIG. 7B is a perspective view of a lock in accordance with one embodiment of the present invention.
Figure 7A:
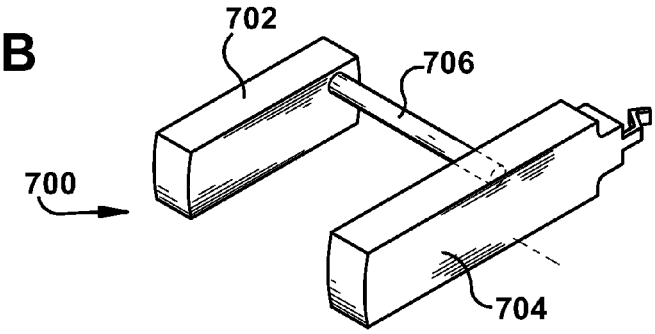
FIG. 7A is a perspective view of a lock in accordance with one embodiment of the present invention.

With reference to FIGS. 6A and 6B, an additional embodiment of the present invention is illustrated. With reference particularly to FIG. 6A, a lock 600 of the present invention includes a first 610 and a second 620 restraining member connected by a rod 630. Rod 630 optionally includes extensions 640 extending longitudinally into each restraining member and defines an axis of rotation for rod 630 and the restraining members. Rod 630 is partially retained in mounting member 650. Mounting member 650 includes a mounting mechanism (e.g., screw holes 655) for mounting lock 600 upon a cabinet member. Upon mounting lock 600 onto a cabinet member, when the restraining members are in a second position (as illustrated in FIG. 6A), the door of the cabinet is free to move through the frame of the cabinet. Upon rotating the restraining members to a first position (as illustrated in FIG. 6B), a cabinet member is trapped between the restraining members and the door is prohibited from moving through the frame. For example, lock 600 may be mounted upon a cabinet frame, and the restraining members may rotate to alternatively trap and free the cabinet door. Alternatively for example, lock 600 may be mounted upon an edge of a door and the restraining members may rotate to trap the cabinet frame when the door is aligned with the cabinet frame.

With reference to FIG. 6B, lock 600 may further include rotation lock retaining member 660. Rotation lock retaining member 660 is adapted for mounting upon a different cabinet member from which mounting member 650 is mounted. For example, mounting member 650 is adapted for mounting upon a cabinet frame and retaining member 660 is adapted for mounting upon a cabinet door. Alternatively, mounting member 650 is adapted for mounting upon a cabinet door and retaining member 660 is adapted for mounting upon a cabinet frame. Mounting member 650 and retaining member 660 are optionally aligned (as mounted) to accommodate interaction between the two when the door upon which one is mounted is aligned with the part of the cabinet frame upon which the other is mounted.

Retaining member 660 optionally includes mount section 670 for mounting upon a cabinet member. Mount section 670 includes any suitable mounting mechanism, including but not limited to one or more screw holes. While a mounting mechanism has been illustrated on mount section 670, it will be appreciated that one or more mounting mechanism may be included upon any suitable part of retaining member 660. Retaining member 660 further optionally includes one or more rotation restraints (not shown) and/or one or more rotation locks 680. Rotation lock 680 is any suitable rotation lock as described herein. In the exemplary rotation lock illustrated in FIG. 6B, tab 690 attached to extension 692 is moved when a force is applied to extension 692 in order to move tab 690 to allow it to freely move between and/or away from retaining blocks 694.

With reference to FIGS. 7A-7D, yet another embodiment of the present invention is illustrated. In this exemplary embodiment, lock 700 includes a first 704 and a second 702 restraining member connected by a rod 706. Lock 700 is adapted for application to a cabinet by placing rod 706 through a suitable hole or other aperture in a cabinet member. For example, a hole is drilled in a cabinet frame with a diameter equal to or slightly larger than the diameter of rod 706. Rod 706 is inserted through the hole and the restraining members are attached to each end of the rod 706 at a distance equal to or slightly wider than the cabinet member to be trapped by the restraining members. The restraining members rotate about an axis of rotation defined by the rod. In an embodiment, lock 700 is mounted into a part of the frame of a cabinet and the restraining members trap the door of the cabinet. In another embodiment, lock 700 is mounted into a door of the cabinet and the restraining members trap the frame of the cabinet when the door and the frame are aligned.

Lock 700 optionally includes rotation lock retaining section 720. Rotation lock retaining section 720 is adapted for mounting on a cabinet member by any suitable mounting mechanism, including but not limited to one or more screw holes 735. Retaining section 720 further retains at least a section of rod 706 and is optionally adapted to abut the first restraining member 704. Retaining section 720 may be mounted on a cabinet member, optionally between the first restraining member and the cabinet member itself. Retaining section 720 further optionally includes one or more rotation restraints 730 and/or one or more rotation locks 740. As the rod 706 is mounted in the cabinet member as opposed to upon an edge of the cabinet member, the rod may be thicker (and thus of greater strength) and the axis of rotation 750 may be farther removed (e.g., higher) from the base 760 of the restraining members and the retaining section.

With reference to FIGS. 9A-9E, yet another additional embodiment of the present invention is illustrated. In this embodiment, a lock 900 further includes one or more friction pads 910. In the event that the distance between the restraining members of lock 900 is greater than the width of the cabinet member to be trapped between the restraining members, at least one friction pad 910 is optionally included on the interior face of one or both restraining members. Such a friction pad is made of any suitably compressible material, including but not limited to foam and/or rubber, which is compressible in order to facilitate movement of the pads over the surface of the trapped cabinet member and which will also expand to ensure a snug fit of the cabinet member between the restraining members. Such a pad may also facilitate movement of the restraining members over the trapped cabinet member without scratching the face of the cabinet member.

Figure 9B:
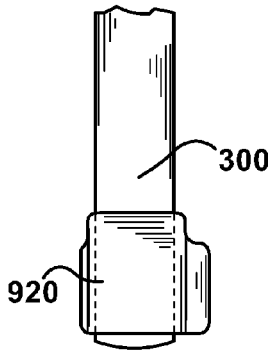
FIGS. 9A-9E are side, perspective and cross-sectional views of a friction pad on a lock in accordance with one embodiment of the present invention.
Figure 9A:
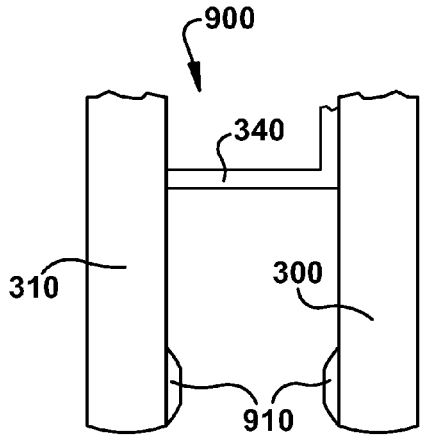
Figure 9C:
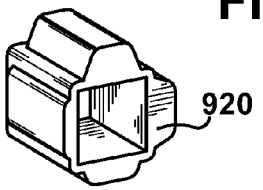
Figure 9D:
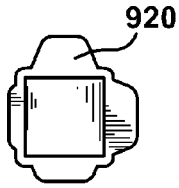
Figure 9E:
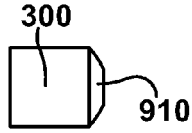

In a further example of a friction pad, with reference to FIGS. 9B-9D, an exemplary adjustable friction pad is illustrated. Such a friction pad 920 is adapted to slide over the end of a restraining member. The friction pad 920 has a plurality of exterior surfaces of different thickness of padding. In the illustrated example, the friction pad 920 has four exterior surfaces of increasing thickness of padding. In embodiments wherein the restraining member has a symmetrical cross-section (such as a square or a circle), the friction pad 920 is adapted to slide onto the end of the restraining member with any of the four sides facing inwards from the restraining member. In this exemplary embodiment, the friction pad is optionally made of a rigid or semi-rigid material. In this regard the friction pad serves the purpose of increasing the diameter of the restraining member, and may be used to obtain a close fit of the restraining members to the trapped cabinet member.

Figure 10:
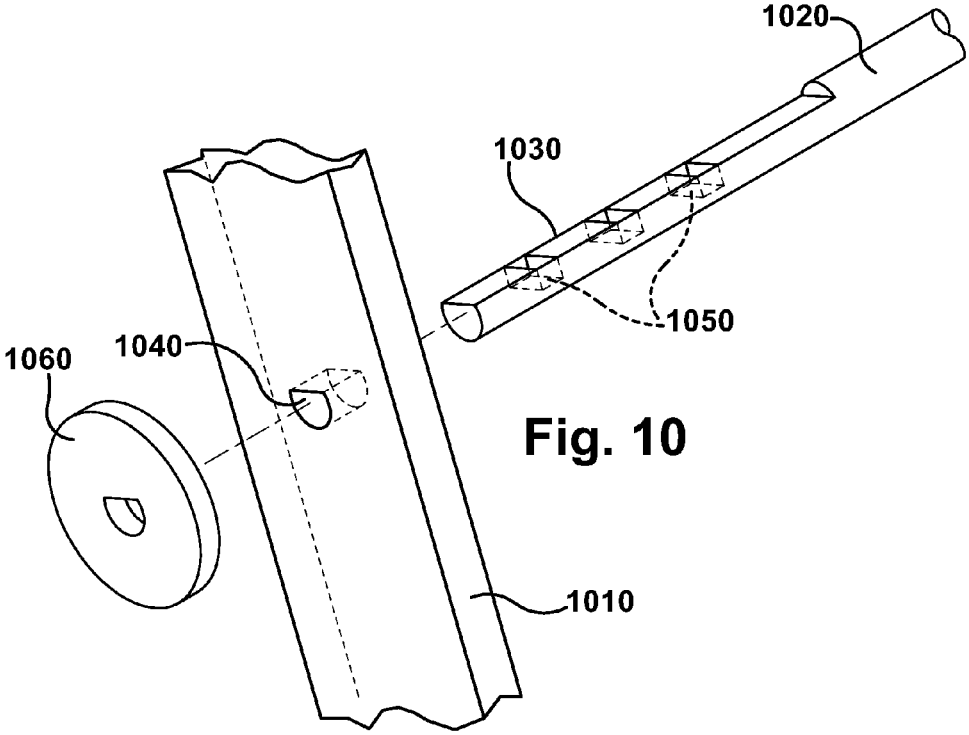
FIG. 10 is a perspective view of an adjustable restraining member of a lock in accordance with one embodiment of the present invention.

With reference to FIG. 10, still yet another embodiment of the present invention is illustrated. In this exemplary embodiment, a cabinet lock of the present invention includes at least one restraining member 1010 which is adjustably connectable to a rod 1020. Restraining member 1010 is adapted for connecting to rod 1020 at a plurality of locations on rod 1020. In this regard the distance between the restraining members may be modified. At least one restraining member is adjustably connected to rod 1020 in any suitable manner. In an example, rod 1020 has at least one adjustable section 1030. While a section of rod 1020 is optionally round (to facilitate rotation, e.g., when the rod is retained in the mounting member), adjustable section 1030 is optionally shaped (in cross section) as a semi-circle or any other suitable shape which tends to resist rotation of the restraining member around the rod (as further described below). Restraining member 1010 has a bore 1040 shaped to fit adjustable section 1030 with the same cross-section. In this regard, rotation of the restraining member 1010 around the rod is inhibited.

The restraining member 1010 may freely move across the adjustable section 1030 until a desired location is determined. Adjustable section 1030 has a plurality of notches 1050 adapted for receiving one or more locks 1060. Once a desired location is determined, lock 1060 is slipped over adjustable section 1030 and moved until it abuts the restraining member 1010. Lock 1060 engages the notch closest to the position of the lock as it abuts the restraining member is its desired location. Optionally a second lock precedes the restraining member to lock the restraining member on the other side. Still further optionally, the restraining member 1010 has a rod engaging mechanism (not shown) which fixes the restraining member to the desired location on the rod 1020.

The components of a lock of the present invention are made of any suitable material, including but not limited to plastic, metal, alloys, vinyl, wood or combinations thereof. In certain embodiments, the rod is made of metal, piano wire or other suitably strong materials while the remaining components are made of durable plastic. In other embodiments, a metal strengthening plate is added for strength.

While the present invention has been illustrated by the description of embodiments thereof, and while the embodiments have been described in considerable detail, the scope of the appended claims should not be restricted or in any way limited to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the invention disclosed herein.

The invention claimed is:

1. A lock for a cabinet of the type wherein a door of the cabinet is movable through a frame of the cabinet, the lock comprising:

a first and a second restraining member connected by a rod and rotatable around an axis of rotation between:

a first position wherein a cabinet member is positioned between the first and second restraining members, and the first and second restraining members restrict the cabinet door from moving through the frame; and a second position wherein the first and second retraining members allow the door to move through the frame;

at least one mounting member having at least one rod-retaining section located between the first and second restraining members, with at least one section of the rod retained by the rod-retaining section and defining the axis of rotation;

at least one rotation-lock for prohibiting rotation of the first and second restraining members when the rotation-lock is engaged with a restraining member; and wherein the rod has at least one end extension angled with an angle greater than zero from the axis of rotation into at least one restraining member.

2. The lock of claim 1, the mounting member further including a strengthening plate.

3. The lock of claim 1, at least one restraining member having at least one friction pad attached thereto.

4. The lock of claim 1 wherein the first and second restraining members with the rod form a rigid "H"-shaped construct.

5. The lock of claim 1 wherein the first and second restraining members with the rod form at least a rigid "U"-shaped construct.

6. A lock for a cabinet of the type wherein a door of the cabinet is movable through a frame of the cabinet, the lock comprising:

a first and a second restraining member connected by a rod and rotatable around an axis of rotation between:

a first position wherein a cabinet member is positioned between the first and second restraining members, and the first and second restraining members restrict the cabinet door from moving through the frame; and a second position wherein the first and second retraining members allow the door to move through the frame;

at least one mounting member having at least one rod-retaining section located between the first and second restraining members, with at least one section of the rod retained by the rod-retaining section and defining the axis of rotation;

at least one rotation-lock for prohibiting rotation of the first and second restraining members when the rotation-lock is engaged with a restraining member; and wherein the first and second restraining members with the rod form a rigid "h"-shaped construct.

7. The lock of claim 6, the mounting member including a mounting means adapted for mounting the mounting member on the cabinet member.

8. The lock of claim 6 wherein the mounting member is adapted to mount on the door of the cabinet and the rotation-lock is adapted for mounting on the frame of the cabinet.

9. The lock of claim 6 wherein the mounting member is adapted to mount on the frame of the cabinet and the rotation-lock is adapted for mounting on the door of the cabinet.

10. The lock of claim 6, further comprising a rotation-restraint for restraining rotation of the restraining members.

11. The lock of claim 6 wherein each restraining member has an exterior edge which faces away from the cabinet member upon which the restraining members are attached when the restraining members are in the second position, and wherein each exterior edge is shaped to allow the door to move through the frame while in the second position.

12. The lock of claim 11, wherein each edge exterior extends less than about 0.25 inch from the cabinet member upon which the restraining members are attached.

13. The lock of claim 6 wherein the first restraining member is adjustably connected to the rod, whereby the distance between the restraining members is adaptable to a width of the cabinet member.

14. The lock of claim 6 wherein the rotation lock has a child-safety lock for selectively allowing rotation of the restraining members.

* * * * *